US005746627A

United States Patent [19]

Bratten

[11] Patent Number: 5,746,627

[45] Date of Patent: May 5, 1998

[54] ELECTRICAL CONNECTION BAR ASSEMBLY AND HOUSING

[76] Inventor: Scott J. Bratten, 14560 - 40th Pl. North, Plymouth, Minn. 55446-7312

[21] Appl. No.: 893,941

[22] Filed: Jul. 15, 1997

Related U.S. Application Data

[63] Continuation of Ser. No. 790,520, Jan. 29, 1997, abandoned, which is a continuation of Ser. No. 311,682, Sep. 23, 1994, abandoned.

[51] Int. Cl.[6] ..... H01R 9/24; H01R 11/09

[52] U.S. Cl. ..... 439/721; 439/798; 439/910

[58] Field of Search ..... 439/709–721, 439/723, 724, 797, 798, 910

[56] References Cited

U.S. PATENT DOCUMENTS

| | | | |
|---|---|---|---|
| 1,303,006 | 5/1919 | Allphin | 439/724 |
| 2,178,092 | 10/1939 | Werner | 439/721 |
| 2,228,139 | 1/1941 | Leonhardy | 29/234 |
| 2,431,999 | 12/1947 | Engelhardt | 439/718 |
| 2,707,774 | 5/1955 | Keller | 439/723 |
| 2,748,365 | 5/1956 | Speck | 439/723 |
| 2,749,385 | 6/1956 | Adam | 219/591 |
| 2,905,923 | 9/1959 | Hammerly | 439/723 |
| 3,133,779 | 5/1964 | Stanbeck | 439/798 |
| 3,150,910 | 9/1964 | Dodd | 439/491 |
| 3,340,496 | 9/1967 | Kennedy | 439/910 |
| 3,354,421 | 11/1967 | Rodgers | 439/723 |
| 3,386,073 | 5/1968 | Pierce | 439/723 |
| 3,560,632 | 2/1971 | Wallace | 439/910 |
| 3,602,871 | 8/1971 | Newman | 439/724 |
| 3,803,343 | 4/1974 | Carlson | 135/159 |
| 4,050,770 | 9/1977 | Rigo | 439/798 |
| 4,231,633 | 11/1980 | Luke et al. | 439/723 |
| 4,263,034 | 4/1981 | Sistermann et al. | 65/79 |
| 4,451,106 | 5/1984 | Wisenheart et al. | 439/724 |
| 4,700,271 | 10/1987 | Iio et al. | 439/723 |
| 5,199,905 | 4/1993 | Fillinger | 439/798 |

FOREIGN PATENT DOCUMENTS

| | | | |
|---|---|---|---|
| 1203219 | 8/1970 | United Kingdom | 439/797 |
| 1209372 | 10/1970 | United Kingdom | 439/797 |

*Primary Examiner*—Hien Vu

*Attorney, Agent, or Firm*—Merchant, Gould, Smith, Edell, Welter & Schmidt

[57] ABSTRACT

An electrical connector bar and assembly housing which includes a plurality of support terminal bars mounted in a single housing unit which can be anchored within a wire trench provided at a convenient access location within the building floor structure to permit modifications to be made in the wiring supports in the building at a selected convenient access location within the trench.

8 Claims, 1 Drawing Sheet

ELECTRICAL CONNECTION BAR ASSEMBLY AND HOUSING

This is a Continuation of application Ser. No. 08/790,520, filed Jan. 29, 1997 now abandoned which is a Continuation of application Ser. No. 08/311,682, filed Sep. 23, 1994 now abandoned.

BACKGROUND OF THE INVENTION

It has been a long existing problem to wire and service the wired circuits in multiple floor buildings which have an electrical wire-containing trench embodied in the building floor structure. The problem is extenuated after the original construction has been completed and additional wiring has to be added to the already in-place wiring and circuitry. Present systems require interrupting the electrical service in the circuits to be modified. This requires that the work be done before or after business hours.

SUMMARY OF THE INVENTION

This device is particularly constructed to provide multiple terminal bars which are all mounted in a single housing but which are electrically separate from each other. The adjacent ends of the bars are electrically insulated from each other. The bars are enclosed within a hollow housing having access openings through which the wire ends can be inserted for connection with a selected terminal connection. The housing is also provided with openings for providing access to suitable wire clamping means such as clamping screws to anchor the respective wire ends to the terminal bars. The housing is preferably transparent to permit visual orientation of the respective terminals and clamping means provided on the terminal bars. The ends of the housing are bevelled to permit wires to be "fished" through the trench in the building floor structure without obstruction and interference.

DETAILED DESCRIPTION OF THE PREFERRED EMBODIMENT

Figure 1:
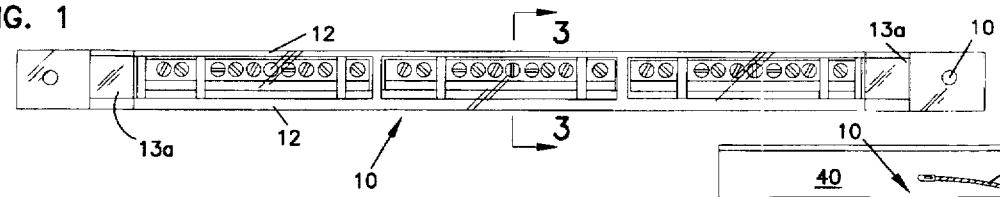
FIG. 1 is a top plan view of an electrical connection bar construction embodying this invention.
Figure 5:
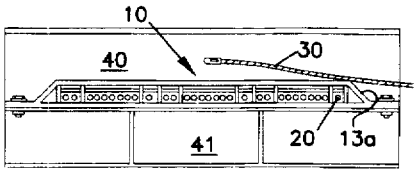
FIG. 5 is a cross-sectional view of the arrangement of FIG. 4 taken along the line 5—5 depicting a wire being fished through a floor trench.
Figure 2:
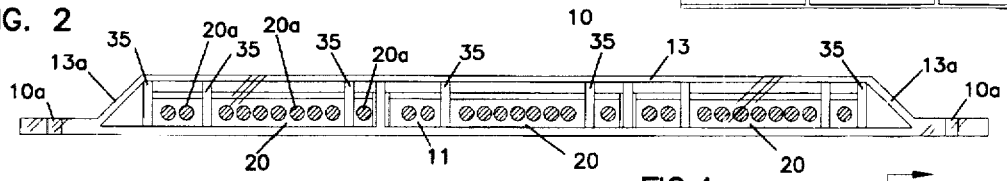
FIG. 2 is a side elevational view thereof.
Figure 3:
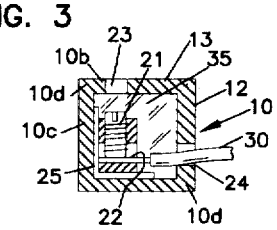
FIG. 3 is a cross-section of the housing assembly illustrated in FIGS. 1 and 2.

As illustrated in the accompanying drawings, this invention provides a transparent terminal bar housing designated as an entity by the numeral 10. The housing 10 is provided with a suitable base 11, side walls 12, and a top 13, to define a terminal bar enclosure 14 there within. The top 13 has bevelled end portions 13*a*, as shown.

In the form of the invention illustrated, three separate terminal bars 20 are provided. Each bar 20 has a plurality of wire connectors 20*a*. Each of the individual wire connectors 20*a* is provided with a clamping screw 21 and a terminal bar opening 22. The clamping screw 21 is aligned with an access opening 23 formed in the top of the housing 10 to permit a screwdriver (not shown) to engage the clamping screw 21. A wire access opening 24 permits a wire such as a wire 30 to be inserted into a selected opening of a terminal bar 20 under a clamping screw 21 which has been retracted. The screw is then tightened to make the connection.

Figure 4:
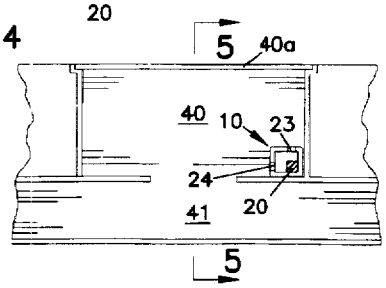
FIG. 4 is a cross-section through the floor of the building.

As best shown in FIG. 4 the housing 10 is anchored at a selected location in the bottom of the wire-containing trench 40 in the building floor at a selected location for optimum accessibility. Suitable holes 10*a* are provided for anchoring screws (not shown) for securing the housing 10 to the trench floor. A cover 40*a* is provided for access to the trench 40 and a cross-trench 41 provides a path for wires travelling at right angles to the wires located in the trench 40.

A plurality of transverse anchoring members 35 are secured within the bottom housing section 10*c* as by being glued therein. This securely anchors the terminal bars 20 to the inside of the bottom housing section 10*c*. The two sections are connected along the bevelled longitudinal corner edges 10*d* after the terminal bars 20 have been secured within the bottom housing section 10*c*.

The circuit wires 30 are securely anchored at the connectors 20*a* for each terminal bar 20. In the form shown this provides 10 individual wire connectors 20*a* for each terminal bar. The partition members 35 not only separate the adjacent ends of the terminal bars 20, but also positively anchor each of the terminal bars to the housing section 10*c*. Since the housing is constructed of nonconductive rigid insulating material, the direct connection of the terminal bar members 20 thereto provides the necessary insulated isolation of each terminal bar although an insulating layer 25 may be inserted between the bars 20 and the housing surface. The wires 30 may be readily fished through the floor cell system of the building (not shown) and the ends of the wires are connected to selected terminal bars 20, each of which represents a separate circuit unit with a plurality of terminals (hot, neutral and ground). Suitable plugs (not shown) may be used to cover any unused holes in the housing 10 until needed.

What is claimed is:

1. An electrical connector arrangement comprising:

(a) an elongated, unitary, one-piece housing having: a first end, a second end, a length between the first and second ends, a front wall, a back wall, a top wall, and a bottom wall;

(i) said housing front wall, back wall, top wall, and bottom wall being constructed from a transparent material and being adapted for mounting on a surface along the housing length;

(ii) said housing front wall including a first plurality of openings constructed and arranged to permit access to an interior of the housing from the front wall of said housing; all of said first plurality of openings positioned an equal distance from said top wall of said housing; said first plurality of openings adapted to accommodate a plurality of electrical wires;

(iii) said housing top wall including a second plurality of openings constructed and arranged to permit access to the housing interior from the top wall of the housing;

(iv) said first end including a first beveled portion extending from the top wall and to the bottom wall, and said second end including a second beveled portion;

(b) a plurality of elongated terminal bars including at least a first elongated terminal bar; said first terminal bar being:

(i) positioned within said housing and mounted on said bottom wall and against said back wall;

(ii) spaced a first distance from said front wall and said first plurality of openings; and (iii) spaced a second distance from said top wall and said second plurality of openings; and (c) a plurality of set-screws engaging said first terminal bar and constructed and arranged to electrically connect said plurality of electrical wires to said terminal bar; each of said set screws being positioned coaxially with one of each of said second plurality of openings; each of said set screws having a first length;

(i) said first length being greater than said second distance; and (ii) said first distance being sufficient to permit insulated portions of said plurality of electrical wires to penetrate into the housing interior prior to uninsulated portions contacting said first terminal bar.

2. An electrical connector arrangement according to claim 1 further including:

(a) a second terminal bar; said second terminal bar being positioned within said housing adjacent to said first terminal bar and being:

(i) mounted on said bottom wall and against said back wall;

(ii) spaced said first distance from said front wall and said first plurality of openings; and (iii) spaced said second distance from said top wall and said second plurality of openings.

3. An electrical connector arrangement according to claim 2 further including:

(a) a partition between said first and second terminal bars; said partition:

(i) electrically insulating said first and second terminal bars; and (ii) anchoring each of said first and second terminal bars to said housing.

4. An electrical connector arrangement according to claim 1 wherein said first plurality of openings are circular.

5. An electrical connector arrangement according to claim 1 wherein said second plurality of openings are circular.

6. An electrical connector arrangement according to claim 1 wherein:

(a) said first beveled portion extends between said top wall and said bottom wall; and (b) said second beveled portion extends between said top wall and said bottom wall.

7. An electrical connector arrangement according to claim 1 wherein:

(a) said housing includes anchoring structure for securing said housing to said surface.

8. An electrical connector arrangement according to claim 7 wherein:

(a) said anchoring structure includes first and second apertures defined by said housing; said first aperture being adjacent said first end, and said second aperture being adjacent said second end.

* * * * *